US009399860B2

(12) United States Patent
Lev

(10) Patent No.: US 9,399,860 B2
(45) Date of Patent: Jul. 26, 2016

(54) POWERED HYGIENE SHOWER SPRAY SYSTEM

(75) Inventor: Mordechai Lev, West Bloomfield, MI (US)

(73) Assignee: Vega Innovations LLC, Cresskill, NJ (US)

( * ) Notice: Subject to any disclaimer, the term of this patent is extended or adjusted under 35 U.S.C. 154(b) by 748 days.

(21) Appl. No.: 13/522,128

(22) PCT Filed: Jan. 17, 2011

(86) PCT No.: PCT/US2011/021478

§ 371 (c)(1), (2), (4) Date: Jul. 13, 2012

(87) PCT Pub. No.: WO2011/088436

PCT Pub. Date: Jul. 21, 2011

(65) Prior Publication Data

US 2012/0286070 A1 Nov. 15, 2012

Related U.S. Application Data

(60) Provisional application No. 61/295,232, filed on Jan. 15, 2010, provisional application No. 61/310,089, filed on Mar. 3, 2010.

(51) Int. Cl.
*E03C 1/06* (2006.01)
*E03C 1/04* (2006.01)

(52) U.S. Cl.
CPC ..... *E03C 1/063* (2013.01); *E03C 1/0408* (2013.01)

(58) Field of Classification Search
CPC .... B05B 15/06; B05B 15/065; B05B 15/066; B05B 15/08; B05B 15/10; B05B 1/18; B05B 1/185; E03C 1/063; E03C 1/0408; E08C 1/066
USPC ..... 239/550, 451–460
See application file for complete search history.

(56) References Cited

U.S. PATENT DOCUMENTS

| | | | | |
|---|---|---|---|---|
| 2,730,737 | A | 1/1956 | Herman | |
| 4,171,094 | A * | 10/1979 | Halfen | E03C 1/063 239/282 |
| 4,964,399 | A * | 10/1990 | Faimali | A47K 3/287 4/615 |
| 5,035,010 | A * | 7/1991 | Sakamoto et al. | 4/567 |
| 5,833,192 | A * | 11/1998 | Buhrman | 248/295.11 |
| 5,974,604 | A * | 11/1999 | Barnea | 4/615 |
| 7,219,376 | B1 * | 5/2007 | Zhou | 4/567 |
| 2003/0132316 | A1 | 7/2003 | Saunders et al. | |
| 2003/0167565 | A1 * | 9/2003 | Yoshida | 4/606 |
| 2004/0118949 | A1 * | 6/2004 | Marks | 239/550 |
| 2006/0255176 | A1 | 11/2006 | Yeiser | |
| 2009/0241257 | A1 * | 10/2009 | Malta | 4/606 |

FOREIGN PATENT DOCUMENTS

| | | |
|---|---|---|
| EP | 0499151 | 8/1992 |
| JP | 2007130578 | 5/2007 |
| JP | 2007229690 | 9/2007 |

* cited by examiner

*Primary Examiner* — Arthur O Hall
*Assistant Examiner* — Juan C Barrera
(74) *Attorney, Agent, or Firm* — Avery N. Goldstein; Blue Filament Law PLlc

(57) ABSTRACT

A powered hygiene shower spray system is provided. The system has a slide bar housing adapted for mounting to a shower chamber substrate. A moving head or spray nozzle is provided that is movable along said slide bar housing. A hose is in fluid communication between a water supply and the spray nozzle when the spray nozzle is moveably present. A control panel accepts user input as to a parameter of the spray nozzle. A drive mechanism is provided for moving the spray nozzle without user manual manipulation of the spray nozzle.

7 Claims, 23 Drawing Sheets

POWERED HYGIENE SHOWER SPRAY SYSTEM

CROSS-REFERENCE TO RELATED APPLICATIONS

This application claims priority of U.S. Provisional Patent Application Ser. No. 61/295,232 filed Jan. 15, 2010, and Ser. No. 61/310,089 filed Mar. 3, 2010, which are incorporated herein by reference.

FIELD OF THE INVENTION

The present invention in general relates to a personal hygiene shower and in particular to a shower body spray head operating with powered, as opposed to manual, positional slide control adjustment.

BACKGROUND OF THE INVENTION

Conventional showerheads are characterized by a fixed mounting point for a showerhead which may be tilted around a ball joint. Often, a showerhead is equipped with a handheld body spray that is either an adjunct to a fixed showerhead or mounts in a fixed cradle. A handheld body spray has the limitation of requiring a user to devote a hand to retaining the handle in a desired spray position. In recognition of these limitations, custom shower systems include a body spray built into the wall of a shower enclosure while a hook mounted within a shower enclosure represents a fixed point from which to hang an otherwise handheld body spray. The fixed position body sprays are unsatisfactory in failing to accommodate users of different heights and the desire to provide therapeutic aqua massage to a particular region of a user body.

The ability to efficiently control the spray pattern, relative ratio of effluent between a fixed showerhead and a body spray, and the position of the body spray not only improves user experience but also leads to more efficient water usage.

Thus, there exists a need for a sliding body spray that provides a range of body spray positions. There further exists a need for a shower system having a way to modify the spray pattern from the body spray, and adjust relative flow between the body spray and a showerhead if present.

SUMMARY OF THE INVENTION

A powered hygiene shower spray system is provided. The system has a slide bar housing adapted for mounting to a shower chamber substrate. A moving head or spray nozzle is provided that is movable along said slide bar housing. A hose is in fluid communication between a water supply and the spray nozzle when the spray nozzle is moveably present. A control panel accepts user input as to a parameter of the spray nozzle. A drive mechanism is provided for moving the spray nozzle without user manual manipulation of the spray nozzle.

A process for operating such a spray system is provided that includes manually engaging the control panel to adjust the position or a parameter of the spray nozzle. Water is allowed to flow from the system with the position or the parameter of the spray nozzle being adjusted without user manual manipulation of the spray nozzle.

DETAILED DESCRIPTION OF THE PREFERRED EMBODIMENTS

Figure 1:
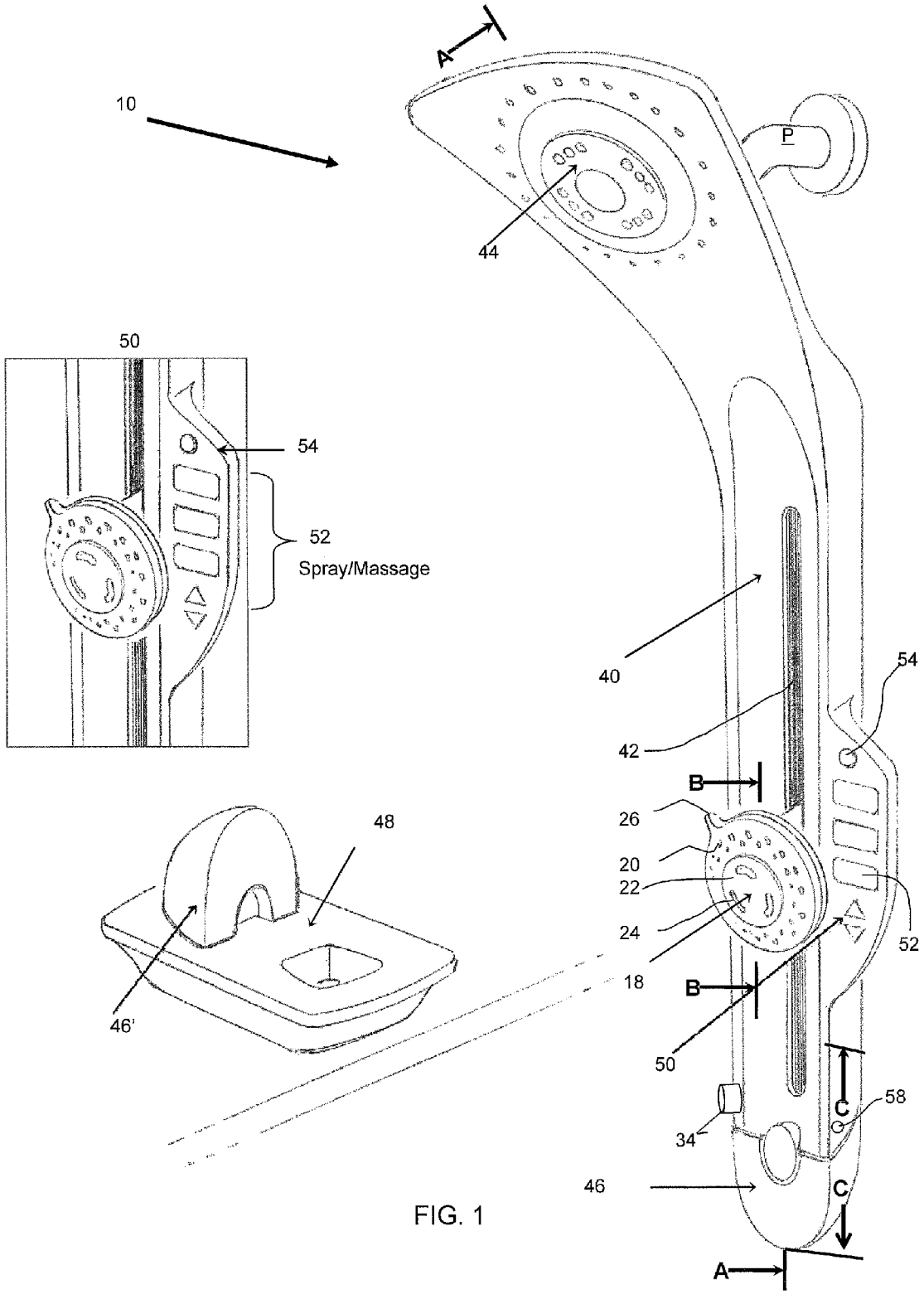
FIG. 1 is a perspective view of an inventive shower system with an inset depicting with greater detail the control board, as well as a charging base for a second battery pack to exchange for the battery housing as depicted coupled to the inventive system.
Figure 2:
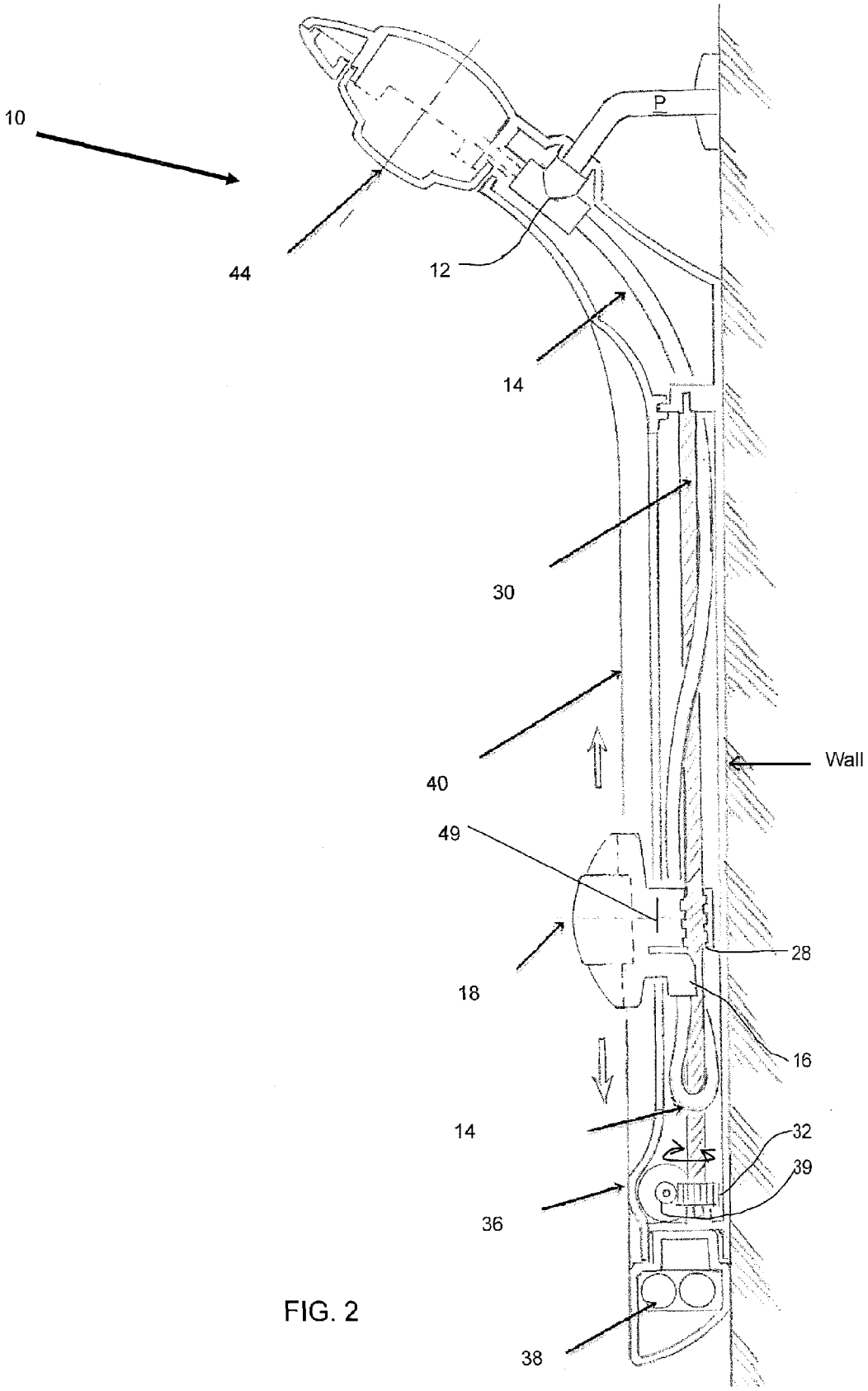
FIG. 2 is a cross-sectional view of the shower system depicted in FIG. 1 along line A-A.
Figure 3:
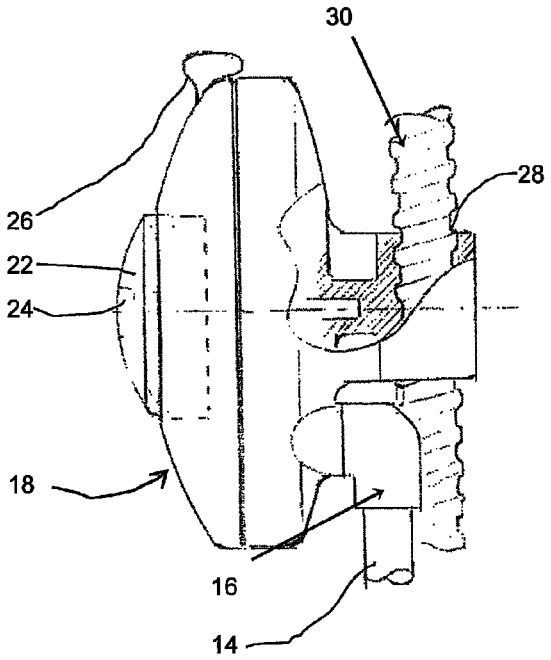
FIG. 3 is a magnified cross-sectional view of the body spray through line B-B of FIG. 1, with a partial cutaway into the body spray head to depict the threaded bore.

An inventive sliding shower body spray provides for selective linear motion of a spray nozzle without manually sliding the spray nozzle between positions. The present invention has utility in providing a high degree of variability in spray nozzle position along the length of a slide bar housing to more efficiently and pleasurably deliver water into a shower chamber and onto a user. The linear motion of a spray nozzle is provided by driving a gear train to in turn move a lead screw that is mechanically coupled to move the spray nozzle relative to a slide bar housing or otherwise moving a powered carriage along the slide bar housing. Power to the gear train is provided through a battery power supply, a mechanical crank, or water pressure. The slide bar housing is adapted for mounting to a wall or a ceiling within the shower chamber. The ability to customize positional and/or spray pattern delivery from an inventive shower system without resort to the conventional activity of manually loosening a fitting, manually repositioning the fitting, and retightening the same enhances the sensory experience of the shower and delivers water more efficiently to rinse a user.

Referring now to FIGS. 1-4, a powered spray system is shown generally at 10. A coupler 12 is mechanically coupled to a pressurized water pipe P. The pipe P is connected to a conventional pressurized water supply such as that of a city. It is appreciated that the coupling 12 readily accommodates a ball joint to provide the ability to tilt to facilitate engagement of the pipe P. The coupler 12 is in fluid communication with a flexible hose 14. The flexible hose 14 terminates in a flexible hose inlet 16 of a traveling spray nozzle 18 that includes multiple nozzle apertures 20. Optionally, the spray nozzle 18 has a secondary spray face 22 having at least one secondary spray face aperture 24. In some embodiments a spray nozzle includes multiple spray faces 22. Multiple spray faces 22 are optionally offset horizontally, vertically, or diagonally. In some embodiments multiple spray faces 22 are offset in the direction closest to the user such that spray from a first spray face is closer to the user than a second spray face.

A grip 26 is optionally provided on the spray nozzle 18 to provide for a manual adjustment of the spray pattern of water emitted from apertures 20, apertures 24, or a combination thereof.

The spray nozzle 18 optionally has a threaded bore 28 that engages a lead screw 30. Rotation of the lead screw 30 crosses the threaded bore 28 to move linearly along the length of the lead screw 30 as denoted by the arrows in FIG. 2. As a result, the threaded bore and lead screw 30 together function as a worm gear. A gear train 32 in mechanical communication with the lead screw 30 converts rotation of the gear train into linear motion of the spray nozzle 18. The gear train 32 is rotated through resort to a manual rotary crank 34, an electric motor 36, or a combination thereof. An electric motor 36 is interfaced by a worm gear 39 to the gear train 32. The motor 36 is powered by a battery power supply 38.

A slide bar housing 40 rotatably secures the lead screw 30 and has a groove 42 therein. The spray nozzle 18 moves along the lead screw 30 with the spray head and nozzle apertures 20 thereof projecting from the groove 42. The slide bar housing 40 is preferably adapted for mounting to a wall or ceiling and includes one or more drain apertures 58 to facilitate drainage of water that enters the housing 40 by way of the groove 42. The housing 40 of FIGS. 1 and 2 also accommodates a showerhead 44. The showerhead 44 is in fluid communication with the pipe P by way of coupling 12.

An inventive sliding shower body spray that includes a motor 36 has a housing 40 with a recess adapted to receive a battery housing 46. Owing to exposure of an inventive spray 10 to water, the interface between the housing 40 and the battery housing 46 optionally includes a waterproof seal therebetween. Optionally, a charging base 48 is provided to charge a second battery pack within a second duplicate battery housing 46' such that when the battery housing 46 no longer has power to drive a motor 36, the battery housing 46 is replaced with the second battery housing 46'. It is appreciated that the charging base 48 and the second battery housing 46' are premised on the batteries 38 within the battery housing 46 being of a rechargeable variety. A battery 38 optionally located within a battery housing 46 is optionally rechargeable. Battery recharging is optionally performed manually, by a connection to a second power source, or by passive mechanisms. An illustrative passive recharging mechanism illustratively includes a dynamo and charging circuit powered by the water flow into the system. Water flow creates motion in the dynamo leading to battery recharging. In some embodiments the power generated by water flow is used to power a control board 50 and optionally the lead screw 30 or other mechanical movement system such as a hydraulic system.

In an electrically powered embodiment of an inventive sliding shower body spray, the power supply can be used to supply power to an optional printed circuit board 49 contained within a control board 50. The printed circuit board is capable of storing multiple modes of spray pattern emitted from the spray nozzle 18 and/or flow rate programs for the operation of the spray nozzle 18 alone or in combination with the showerhead 44. The control board 50 includes one or more buttons 52 and an optional indicator 54 such as a light emitting diode to allow a user to adjust the position of the spray nozzle 18, the ratio of water effluents from the spray nozzle 18 relative to the showerhead 44 or stationary body sprays 102, the spray pattern from the spray nozzle 18 or 102, or a combinations thereof. The buttons collectively shown at 52 illustratively provide positional or spray attributes such as "upper back", "lower back", "spray massage", and opposing displaced control buttons to target a particular "spot" on a user back. In operation, a user opens a valve to start water flow to spray nozzle 18 and engages a button 52 of the control panel 50 to induce a specific movement or initiate a program for the movement of the nozzle 18 or change a parameter of operation for the spray nozzle 18. In response to water intercalation into closed portions of the system 10, a gravity fed drain aperture 58 is optionally provided.

Figure 5:
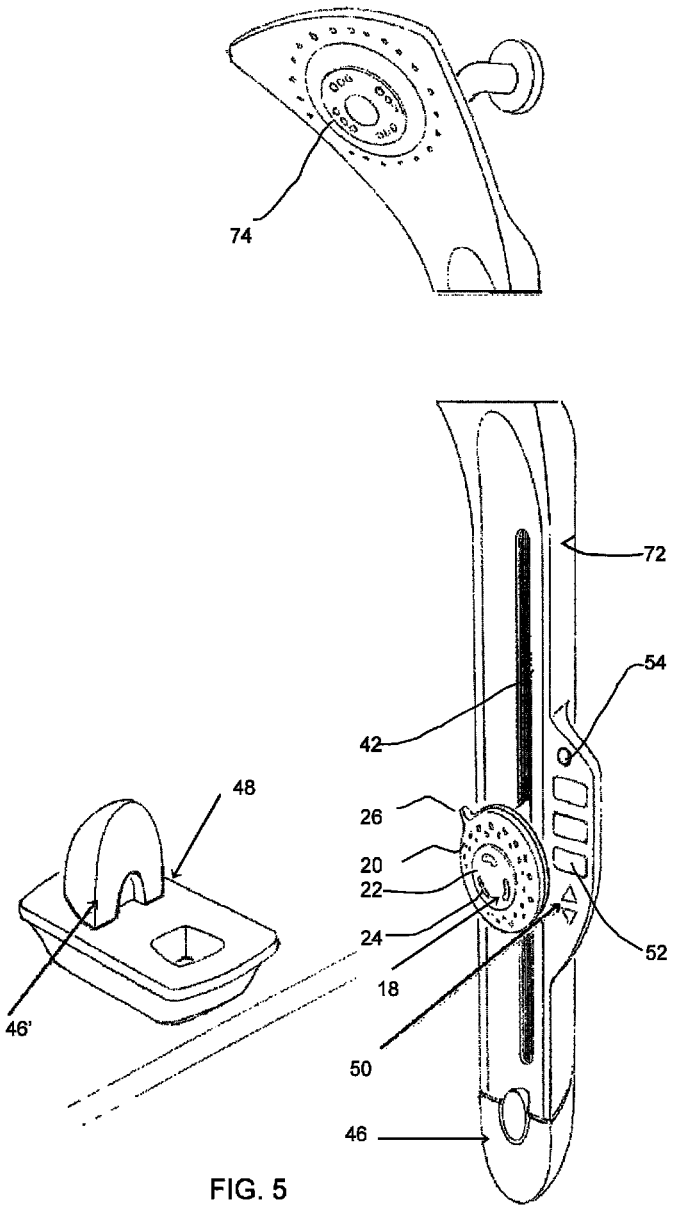
FIG. 5 is a perspective view of an inventive sliding body spray with a separate showerhead.

Referring now to FIG. 5 where like numerals correspond to those used with respect to the aforementioned figures, a spray system is shown generally at 70 and is remarkable from the variant depicted in FIG. 1 in that a housing 72 lacks an integral showerhead 44 and instead is coupled to a pipe P by way of flexible hose 14, but otherwise functions as that detailed with respect to the previously detailed figures. It is appreciated that the housing 72 is readily coupled directly to pipe P with no separate showerhead 74 being present.

Figure 6:
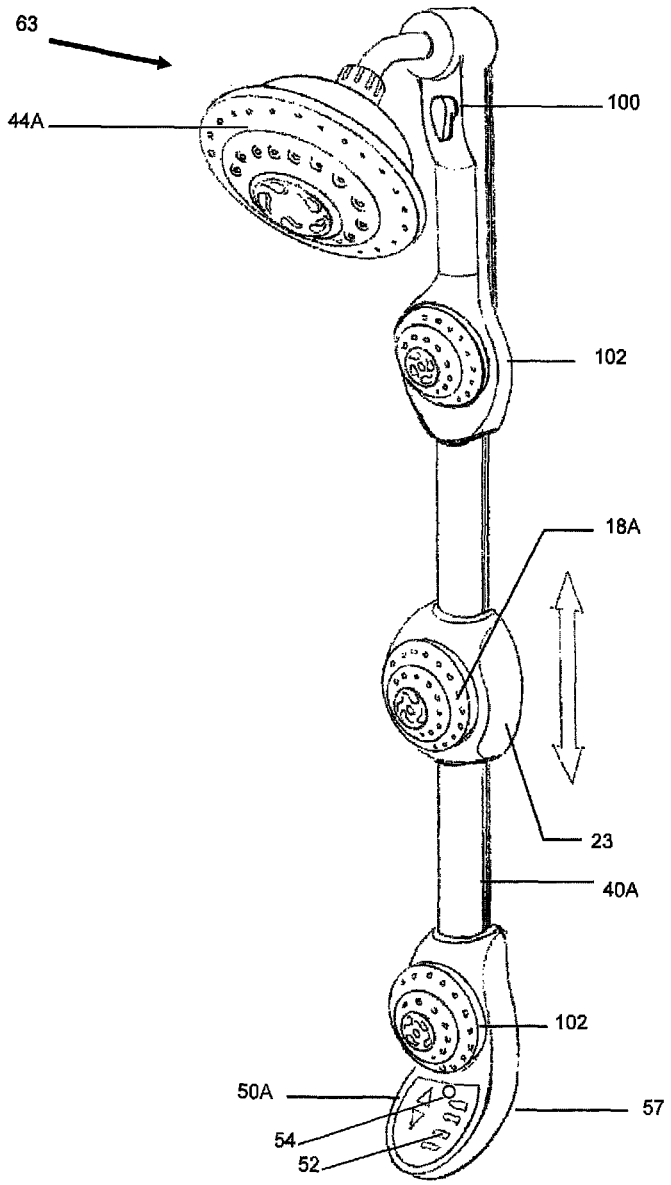
FIG. 6 is a perspective view of an inventive shower system with stationary body sprays and a diverter.

Referring now to FIG. 6, where like numerals with respect to the other application figures have the meaning ascribed thereto, an inventive shower system is shown generally at 63. Those reference numerals modified to include an alphabetical modifier denote an element with a different appearance but a like function with respect to the base numeral. A slide bar housing 40A optionally contains one or more stationary body spray generating housings 102. The one or more stationary body sprays 102 are optionally vertically aligned with the traveling spray nozzle 18A within the traveling spray nozzle housing 23. It is appreciated that other alignments or offsets are similarly embodied in the present invention. In some embodiments at least two stationary body spray housings 102 are present. In some embodiments three or more stationary body sprays 102 are present.

A diverter 100 is optionally present for selecting water flow from either the showerhead 44A, stationary body sprays 102, traveling spray nozzle housing 23, or combinations thereof. A Y valve, T valve, or other conventional valve is suitable as a diverter 100. The motor, battery (if present), gear and drive components are collectively denoted as being present at 57 and synonymously referred to as the drive mechanism. This drive mechanism corresponds to the aforementioned components per FIGS. 1-5. The traveling spray nozzle housing 23 is connected to a drive mechanism as detailed in the preceding figures. The traveling spray nozzle housing 23 moves along slide housing 40A shown with respect to the arrow adjacent to the system 63. The control panel 50A varies in shape relative to control panel 50 detailed with respect to FIGS. 1-5 yet includes one or more buttons 52 and an optional indicator 54 for the control of traveling body spray 22A. The drive mechanism for traveling spray nozzle housing 23 is preferably battery powered either with disposable or rechargeable batteries. Alternatively, the controls 50A include a dynamo and a charging circuit with movement of the dynamo to generate electrical power being powered by water emitted through the inventive shower system 63. The dynamo and charging circuit provide electrical power for recharging rechargeable batteries compartmentalized within the system 63 and in electrical communication with the control panel 50A. Alternatively, it is appreciated that skilled persons will recognize that traveling body spray 22 is readily powered to move along slide housing 40A directly by water pressure associated with a water supply from pipe P.

All or part of the drive mechanism 57 provided either within the traveling spray nozzle housing 23 or alternatively, within a stationary portion of the system 63 with the proviso that electrical communication is maintained between the control panel 50A and traveling spray nozzle housing 23. It is appreciated that a simplified system results when the motor, drive, and gear are located proximal to the control panel 50A. In response to water intercalation into closed portions of the system 63, a gravity fed drain aperture 58 is optionally provided.

Figure 7:
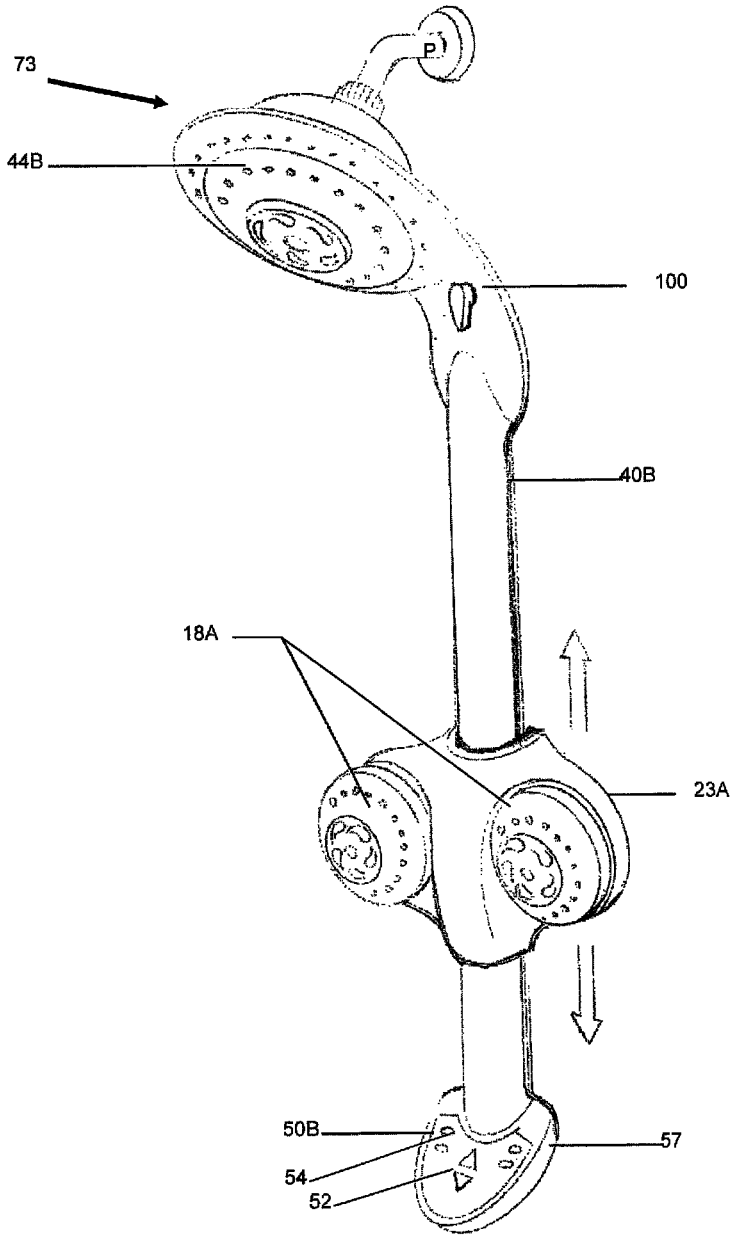
FIG. 7 is a perspective view of an inventive shower system including a traveling housing that contains more than one body spray.

Referring now to FIG. 7, where like numerals with respect to the preceding figures have the meaning ascribed thereto, an inventive shower system is shown generally at 73. Those reference numerals modified to include an alphabetical modifier denote an element with a different appearance but a like function with respect to the base numeral. The system 73 has a slide housing 40B having a traveling body spray generating housing 23A including at least two body spray nozzles 18. The traveling body spray generating housing 23A travels along the slide bar housing 40B based on commands issued through user inputs into the control panel 50B. The control panel 50B, like control panels 50A and 50, includes one or more buttons 52 and an optional indicator 54 to allow a user to adjust the position of the housing 23A, the ratio of water effluence from the body spray nozzles 18 relative to one another or showerhead 44B, or any stationary body sprays, the spray pattern from a body nozzle 18, or a combination thereof. It is noted that FIG. 7 lacks a stationary spray generating housing 102 for visual clarity, yet such a housing 102 is readily incorporated into the system 73.

Figure 8:
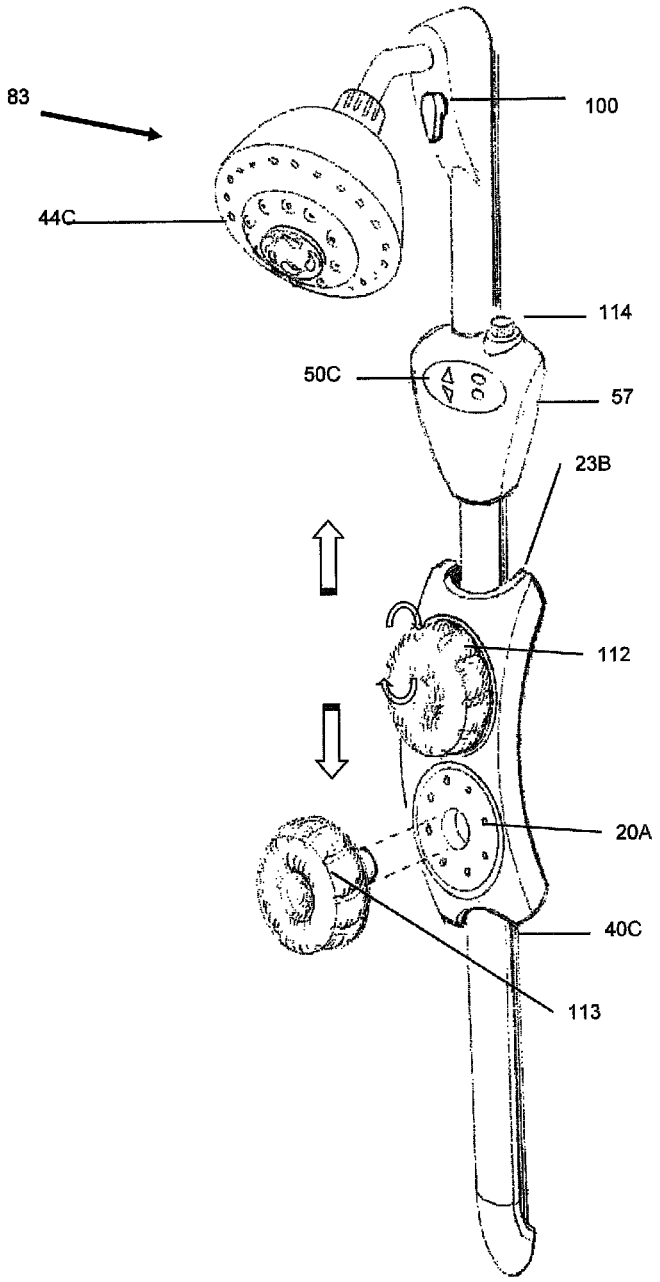
FIG. 8 is a perspective view of an inventive shower system that includes a plurality of moving heads.

Referring now to FIG. 8, where like numerals with respect to the other application figures have the meaning accorded thereto, an inventive shower system is shown generally at 83. Those reference numerals modified to include an alphabetical modifier denote an element with a different appearance but a like function with respect to the base numeral. Slide bar housing 40C engages traveling housing 23B that is in electrical communication with a control panel 50C. A traveling housing 23B optionally includes a motor or other drive system else such components collectively denoted at 57 that are proximal to the control panel 50C. It is appreciated that a traveling housing 23B optionally includes the control panel 50C and some or all of the drive mechanism components 57 integral therewith.

A traveling housing 23B optionally includes one or more moving heads 112 that are optionally stationary, rotatable, pulseable, or otherwise movable. A moving head 112 optionally includes an attachment 113 such as a sponge, loofah, massaging head, or other mechanism designed for contact with one or more regions of a user's body, one of such is shown in exploded view in FIG. 8. One or more moving heads 112 are optionally individually adjustable and may be controlled in a regular or irregular pattern. Illustratively, when a first moving head 112 is moving upward, a second moving head 112 is optionally stationary or moving downward. In some embodiments the moving heads 112 move in synchronous fashion. A moving head 112 is optionally removable or replaceable such that wear, soiling, or other condition can be remedied by removing a moving head and replacing it with a new moving head or washing the existing moving head and reattaching it to the traveling housing 23B for subsequent use. In some embodiments two or more moving heads 112 are present. Two or more moving heads 112 are optionally offset in a plane or angularly with respect to other moving heads 112. The one or more moving heads optionally engage the lead screw of the drive mechanism to induce rotation thereof. The one or more nozzle apertures 20A optionally deliver water, soap, moisturizer, or other desirable fluid into the moving head or past the moving head for subsequent contact with the body. One or more moving heads 112 are optionally treated with an antibacterial treatment so as to prevent soiling of the moving heads 112.

Figure 4:
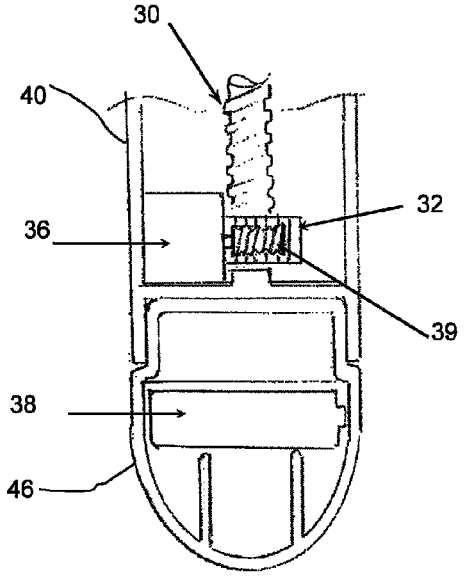
FIG. 4 is a cross-sectional view through the inventive shower system of FIG. 1 along line C-C and orthogonal to that of line A-A.

Rotation of a moving head 112, if the system 83 is so equipped, preferably relies on conventional drive mechanism components such as 32 and 39 detailed with respect to FIG. 4 to provide rotational drive to a moving head 12 in lieu of a motor 36 per FIG. 4. It is appreciated that a traveling housing 23B is readily configured to provide movement along the slide housing 40C, rotation of moving head 112, a combination thereof, or several such motions through routine gear structures. By way of example, a conventional lathe provides components for such movements occurring individually or in concert. An optional soap compartment 114 is present in optional fluidic contact with a removable head 112. In some embodiments a soap compartment 114 is in contact with a spray, pump, or other release mechanism whereby soap is delivered to a moving head 112 or directly to the user. A traveling housing 23B is optionally battery powered, water pressure activating dynamo powered, or passively powered similar to that powering mechanisms described herein or otherwise known in the art.

Figure 9:
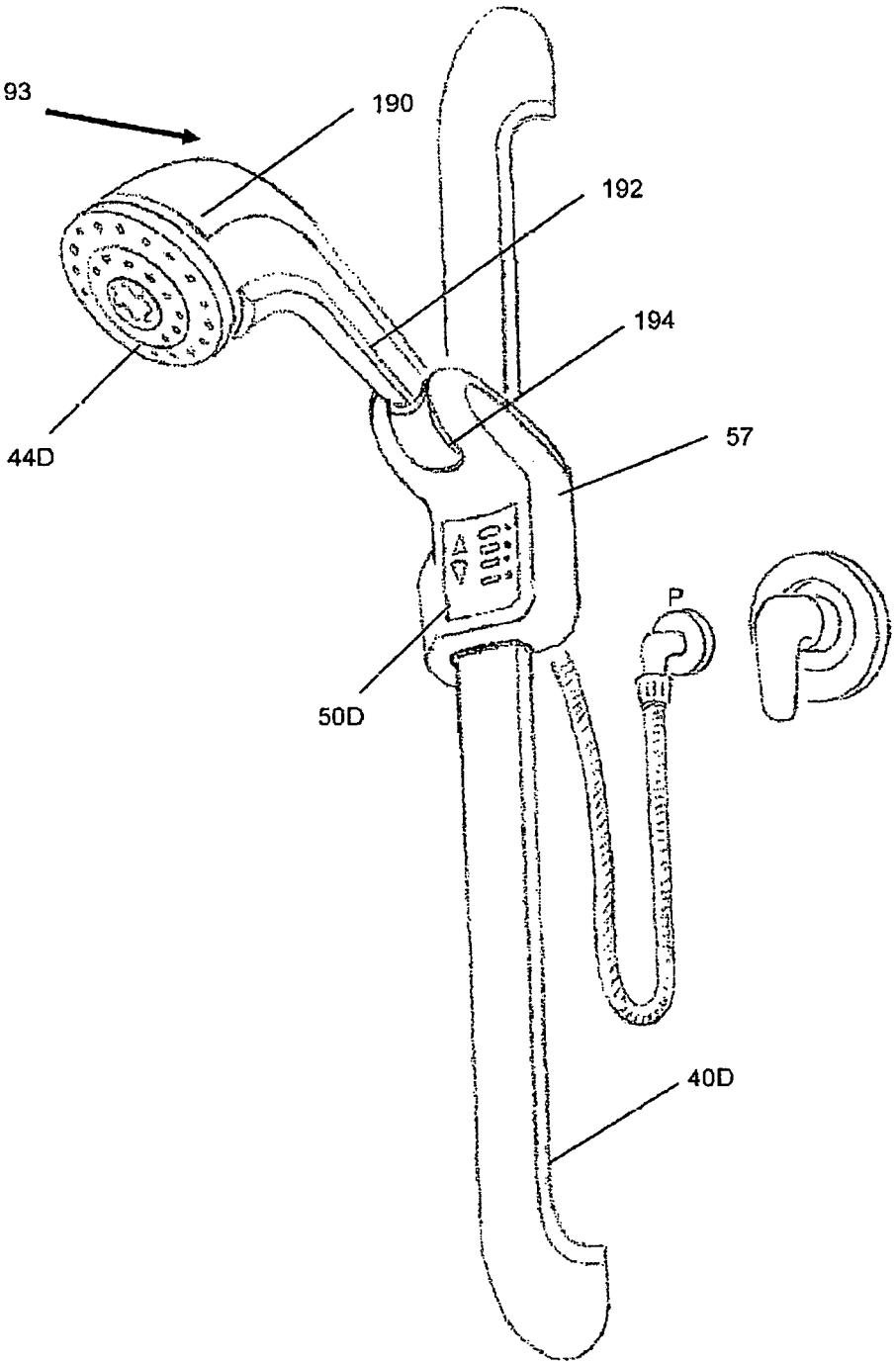
FIG. 9 is a perspective view of an inventive shower system with a positionally adjustable showerhead associated with a traveling housing.

Referring to FIG. 9 where like numerals with respect to the other application figures have the meaning ascribed thereto, an inventive shower system is shown generally at 93. Those reference numerals modified to include an alphabetical modifier denote an element with a different appearance but a like function with respect to the base numeral. A traveling carriage 110 optionally drives the position of one or more showerheads 44D. A showerhead 44D is optionally housed in a body 190 that is connected to or is shaped in the form of a handle 192. A handle 192 optionally is movably or removably connected to a traveling carriage 110. A handle mount assembly 194 is optionally used to connect the handle 192 to a traveling carriage 110. A handle mount assembly 194 optionally provides angular, rotational, or other positional adjustment of the showerhead 44D. A user is able to adjust the positional and water delivery of the showerhead 44D using the control panel 50D or other method. A handle 192 is optionally removable from the mount assembly 194, the traveling carriage 110, or both. The drive mechanism components 57 engage a slide bar housing 40D.

Figure 10:
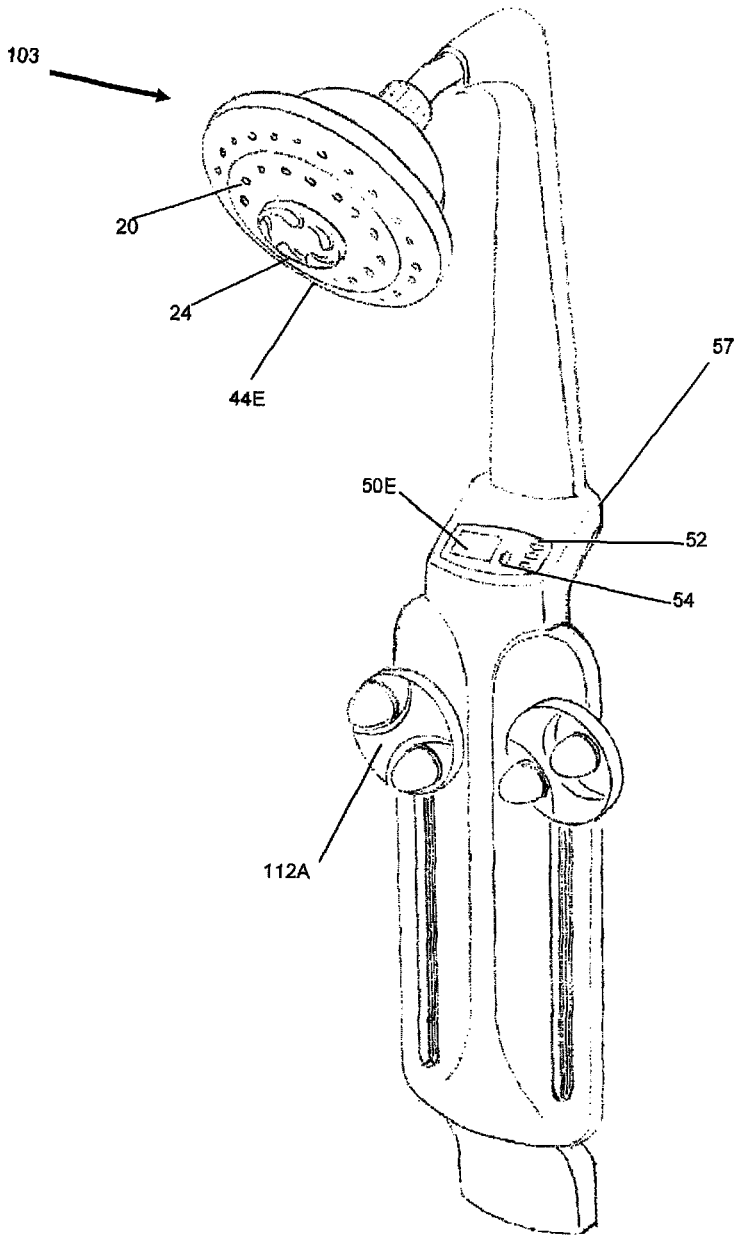
FIG. 10 is a perspective view of an inventive shower system that includes two movable shiatsu massaging heads.

Referring to FIG. 10 where like numerals with respect to the other application figures have the meaning ascribed thereto, an inventive shower system is shown generally at 103. Those reference numerals modified to include an alphabetical modifier denote an element with a different appearance but a like function with respect to the base numeral. A water supply system terminating in showerhead 44E. A control panel 50E along with motor, gear, and batteries collectively depicted at 57 are within a stationary body 111. The body 111 includes a separately movable moving head 112A that moves along a gear train within the body 111, the gear train operating with components as detailed with respect to FIGS. 1-5. The moving head 112A is capable of linear displacement, rotation, or a combination thereof. The moving heads 112A depicted in FIG. 10 are appreciated to be particularly well configured for operation as shiatsu massage.

Figure 11:
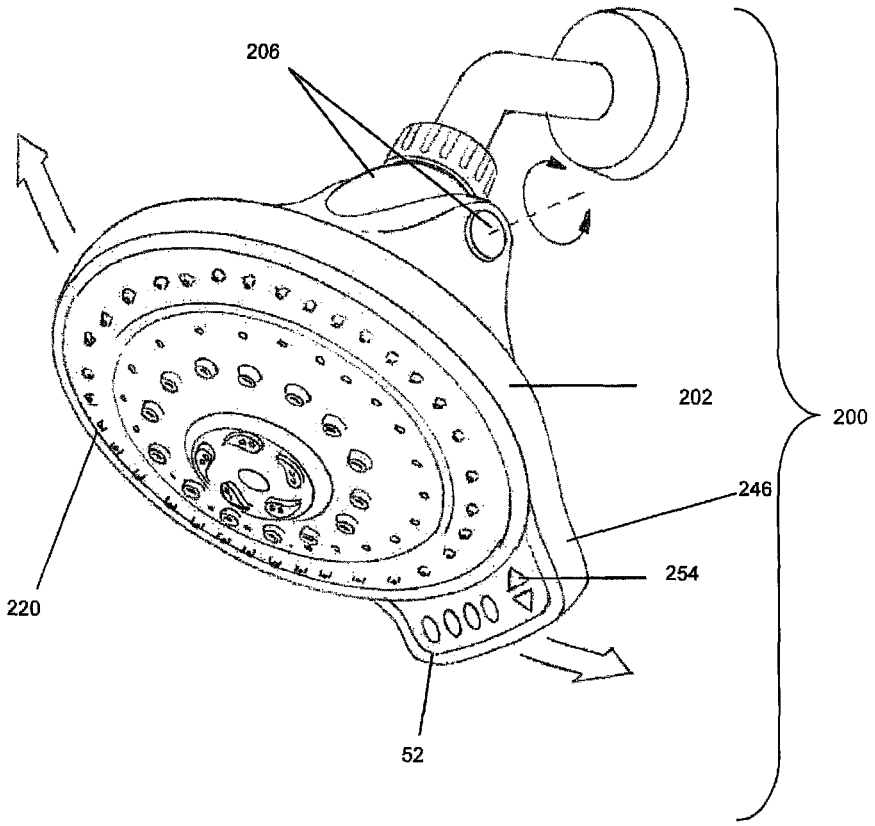
FIG. 11 is a perspective view of an inventive showerhead including a tilting mechanism.
Figure 12:
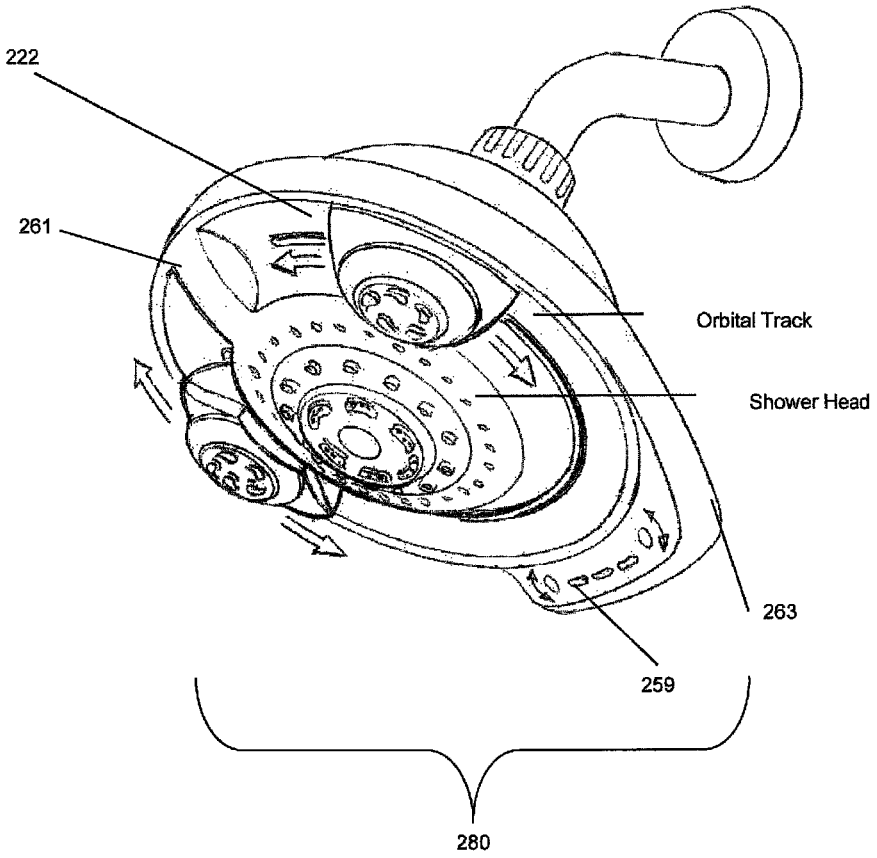
FIG. 12 is a perspective view of an inventive showerhead including two orbitally moving secondary spray faces positionally controlled by a control panel integral with the showerhead body.
Figure 13:
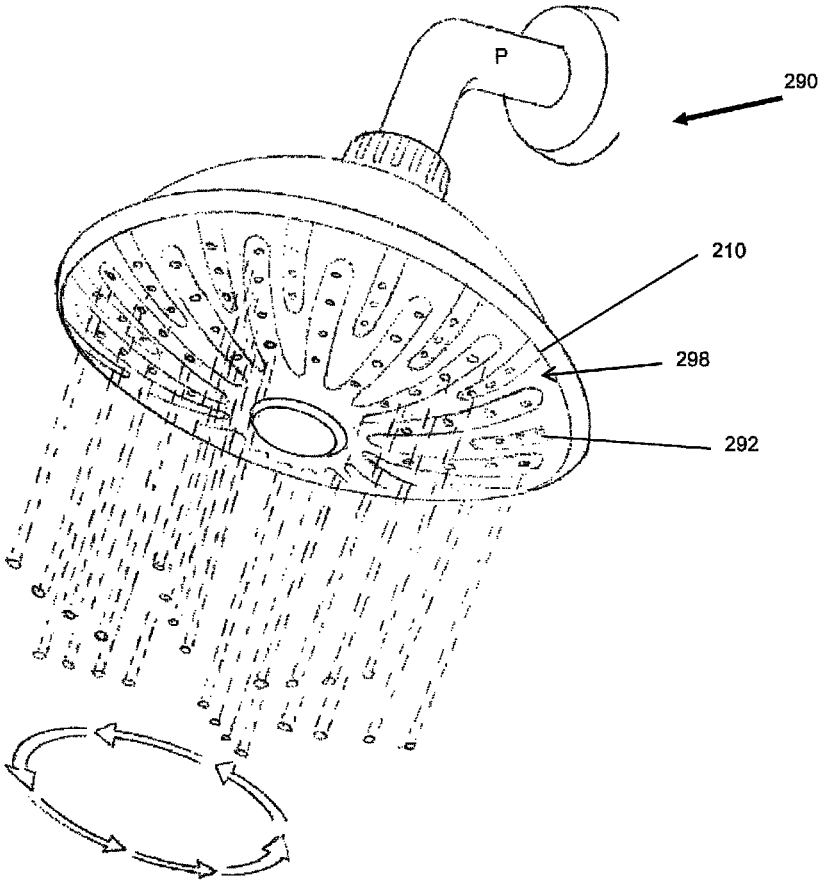
FIG. 13 is a perspective view of an inventive showerhead with a rotatable disk.

Referring to FIGS. 11-13, an inventive showerhead 200 is provided whereby the positional, directional, rotational, or other characteristic of the showerhead 200 is adjustable by a mechanical or other movement mechanism electrically coupled to a control panel 52. It is appreciated that the inventive showerhead is optionally coupled with one or more body sprays and the characteristics of each are interchangeable. It is appreciated that a control panel 252 is connected to a battery compartment 246 as otherwise described herein with respect to 46. A control panel 252 allows a user to initiate a dynamic tilt without the need for additional manual manipulation of the showerhead 200. Tilt range buttons 254 allow for specific adjustment of the tilt range. A tilting mechanism 206 is powered to adjust the spray angle of water leaving the showerhead apertures 220. A tilting mechanism 206 is either mechanically or electrically powered. The inventive showerhead 200 is optionally coupled with one or more body sprays 18 as detailed herein. The showerhead 200 alone or in concert with one or more body sprays 18 optionally provides a user an automatically adjusting tilting function creating a whole body experience with moving, changeable, or otherwise adjustable sprays. An electrically powered tilt mechanism 206 is powered by disposable or rechargeable batteries. A tilting mechanism is readily constructed using a gearing arrangement conventional to that found in an oscillating fans and sprinklers such as those shown in U.S. Pat. Nos. 4,545,532; and 4,732,539. It is appreciated that the powered tilting mechanism is also readily powered by a dynamo moved with pressure from pipe P or directly by water movement.

An inventive showerhead 280 as depicted in FIG. 12 optionally includes one or more secondary spray faces 222. A secondary spray face 222 is optionally in a fixed position, or is rotatable within or about the showerhead primary spray face 208. In some embodiments two or more secondary spray faces 22 are present. A secondary spray face 222 optionally moves orbitally within or about the primary spray face 208. The spray of a primary spray face 208 and a secondary spray face 22 is optionally uniform or individually adjustable. Illustratively, a primary spray face 208 may deliver a uniform flow whereas a secondary spray face delivers a pulsed spray. The sprays and positions of the primary spray face 208 and secondary spray face 222 are individually adjustable and controllable by user input at a control panel 259. A control panel 259 allows a user to initiate a dynamic rotation of spray face 261 without the need for additional manual manipulation of the showerhead 280. Rotation of spray face 261 range buttons 254 allow for specific adjustment of the rotation of spray face 261 range.

Referring to FIG. 13, an inventive showerhead 290 includes a primary spray face 298 optionally including a rotating disk 210 that rotates the position of spray from each aperture 292 during use. The rate of rotation is adjustable and is variable to any desired level. In some embodiments the rotating disk 210 rotates from about 0.5 to 100 revolutions per minute. It is appreciated that the rotational rate is optionally faster or slower depending on the desires of the user. A rotating disk 210 is optionally powered by water flow whereby increased water flow increases the rate of rotation. Alternatively, or in addition, the rotation of the rotating disk is powered by one or more batteries housed with the showerhead 200 or at a remote location. A mechanically rotatable showerhead operative herein to dynamically change the spray pattern without user manual manipulation after control panel initiation is detailed in PCT/US2010/025333. The control panel 259 is preferably connected to a battery stored within a housing 263 also containing the drive system and motor. A user initiates a rotary dynamic spray pattern through engaging the interface of control panel 259 and the spray face 261 dynamically changes the spray pattern from showerhead 280 without the need for additional manual manipulation.

Figure 14:
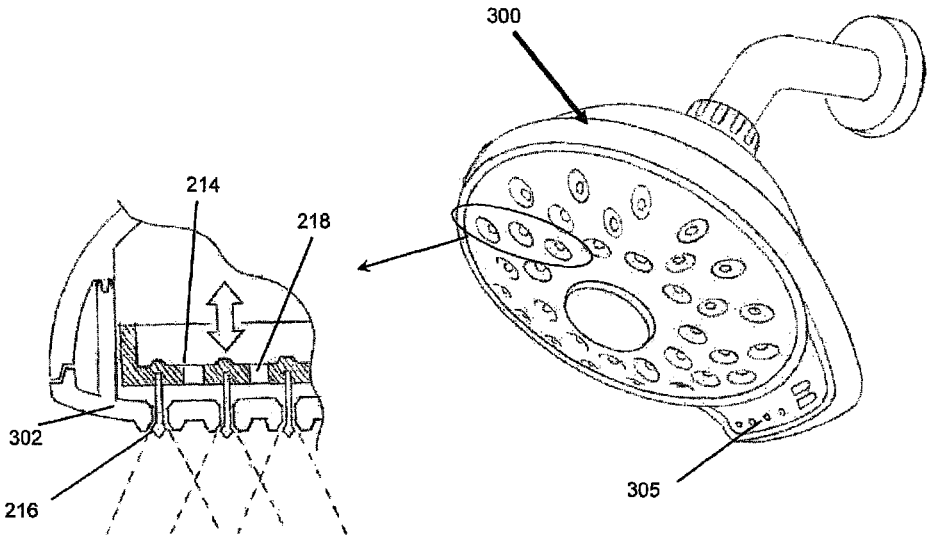
FIG. 14 is a cross-sectional view of an inventive showerhead with an adjustable needle plate.
Figure 15:
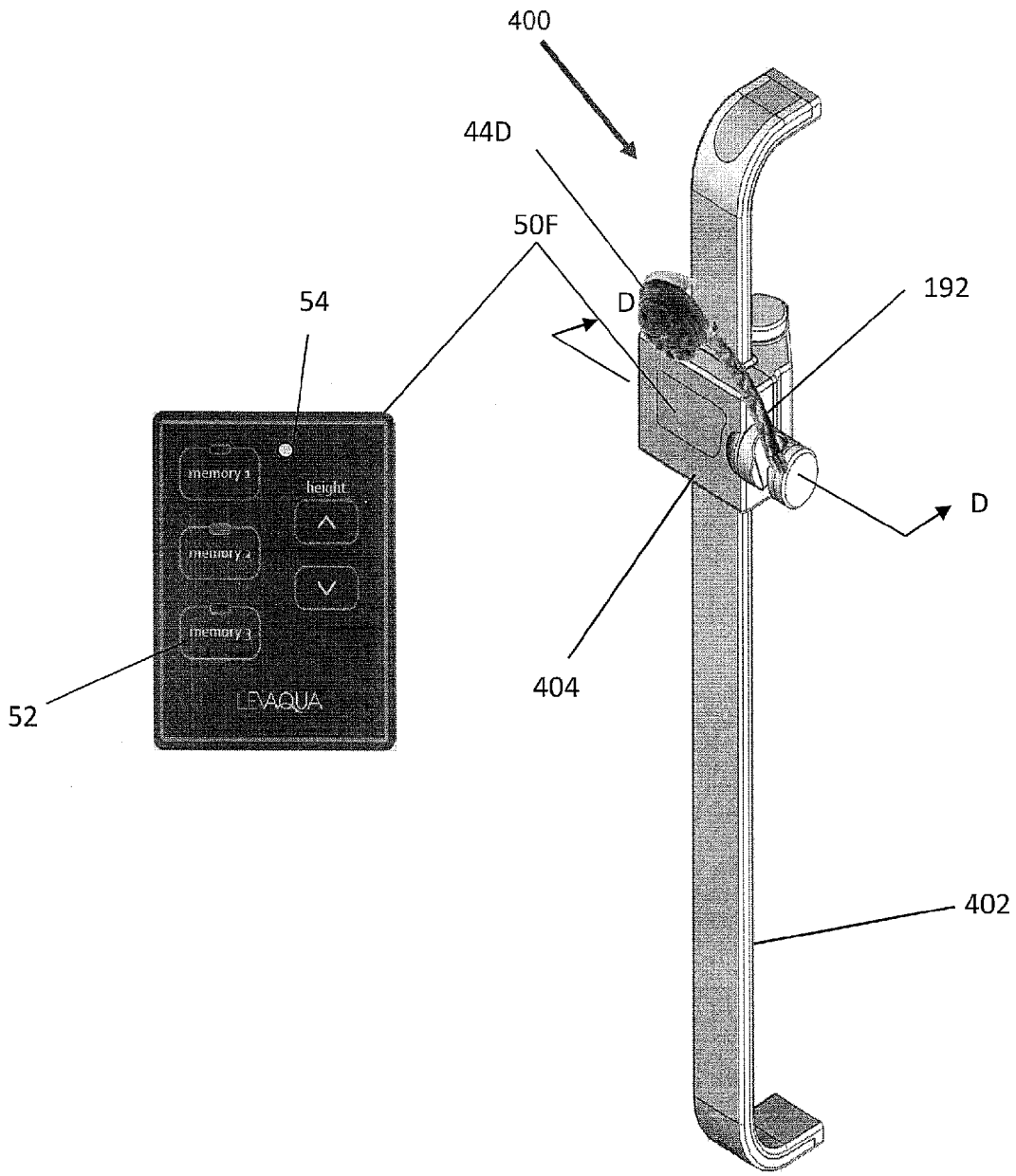
FIG. 15 is a perspective view of an inventive shower system with a digital slide bar that includes a holster for a body spray nozzle, along with an insert depicting in greater detail the control board.
Figure 16:
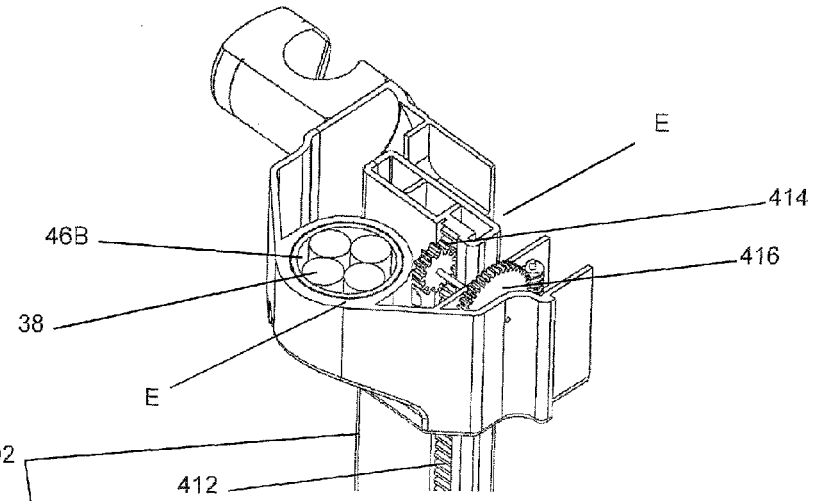
FIG. 16 is a cross-sectional view of the shower system depicted in FIG. 15 along line D-D.
Figure 17:
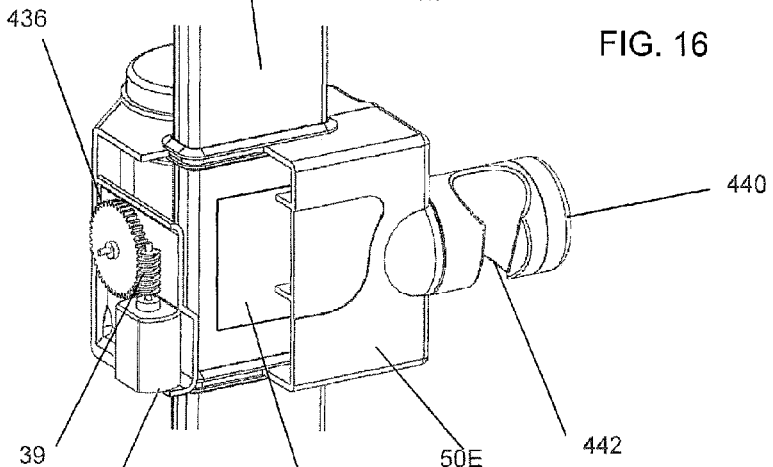
FIG. 17 is a partial cutaway view of the shower system depicted in FIG. 15 to better illustrate the relationship between the motor and gear train.
Figure 18A:
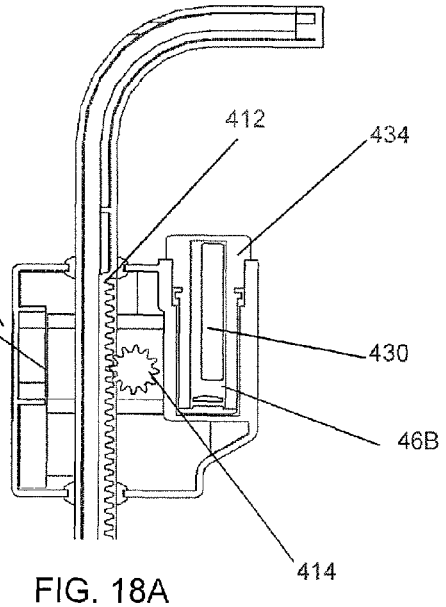
FIG. 18A is a cross-sectional view of the shower system of FIG. 15 along line E-E as shown in FIG. 16.
Figure 18B:
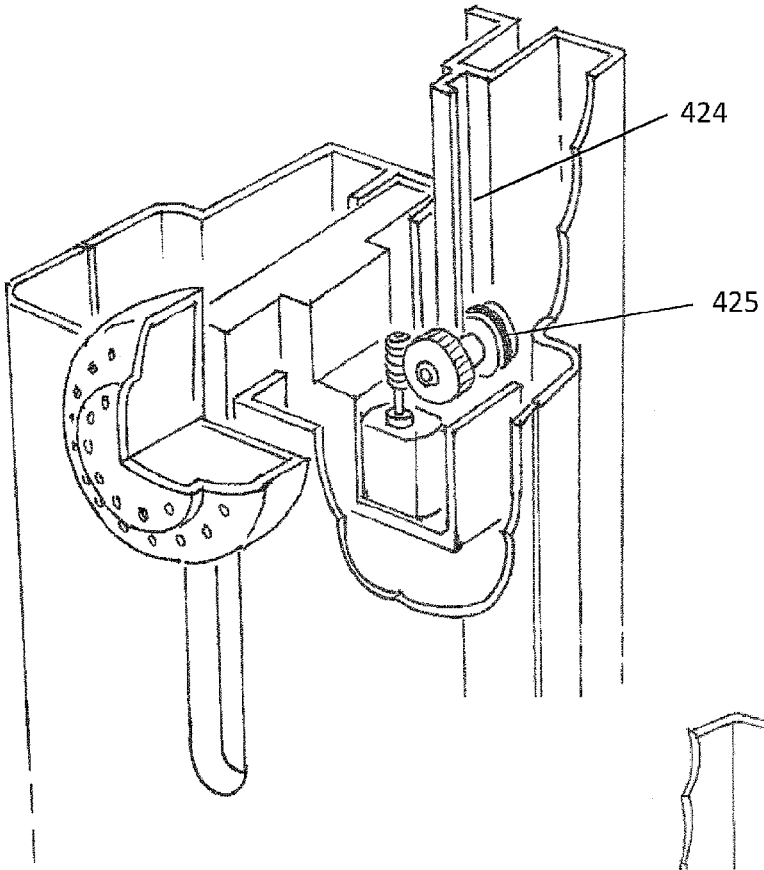
FIG. 18B is a partial cutaway view on a friction wheel—slide bar housing alternate interface to that depicted in FIG. 18A.
Figure 18C:
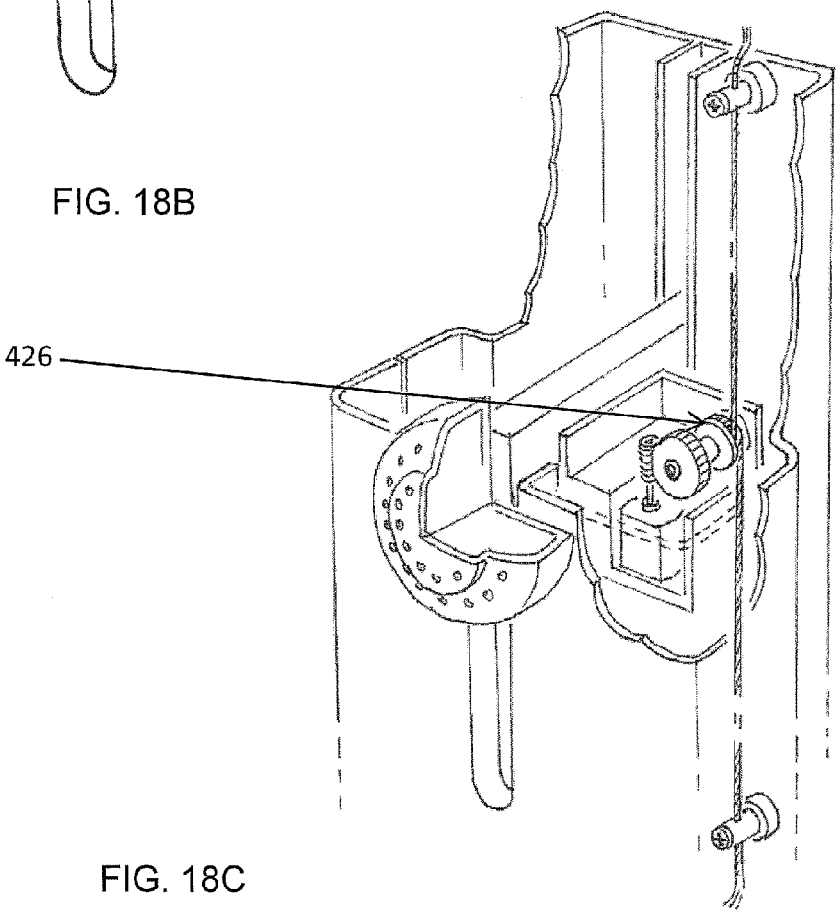
FIG. 18C is a partial cutaway view on a pulley-belt alternate interface to that depicted in FIG. 18A.
Figure 19:
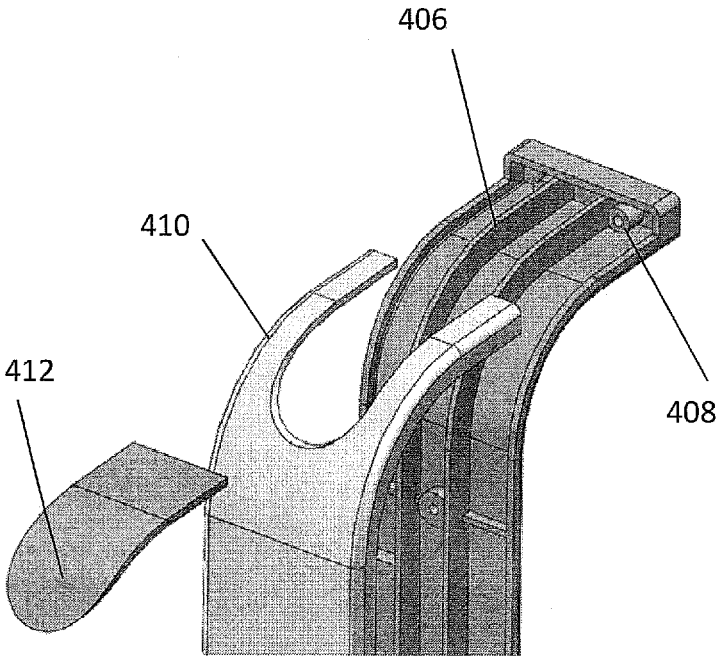
FIG. 19 is an exploded view of the top end portion of the slide bar housing of FIG. 15.
Figure 20:
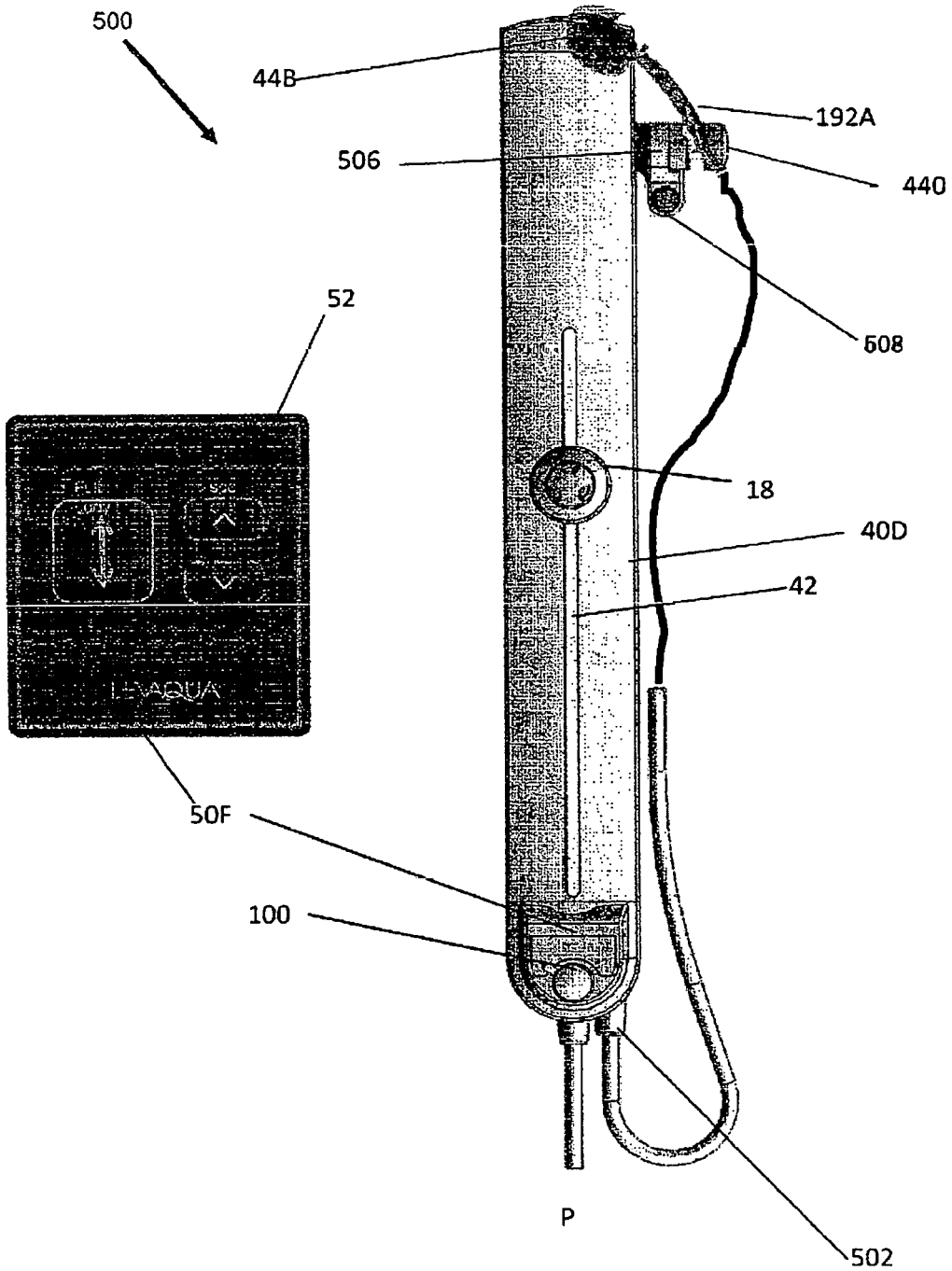
FIG. 20 is a perspective view of an inventive shower system with a sliding digital spray nozzle and a slidable holster for a handheld spray head with an inset depicting in greater detail the control panel.
Figure 21:
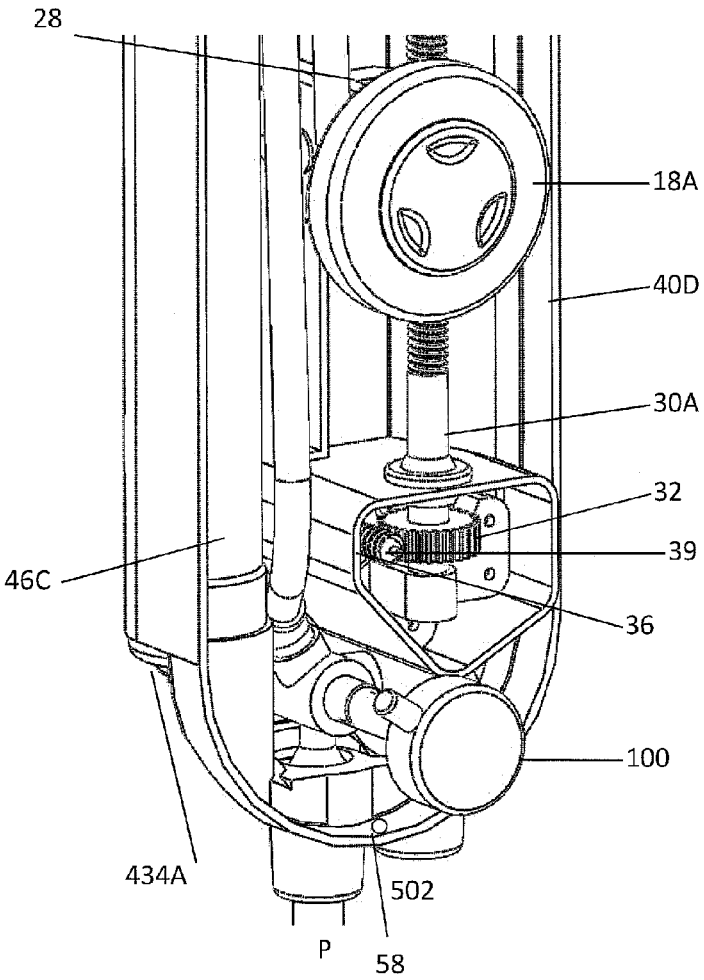
FIG. 21 is a partial cutaway perspective view.
Figure 22:
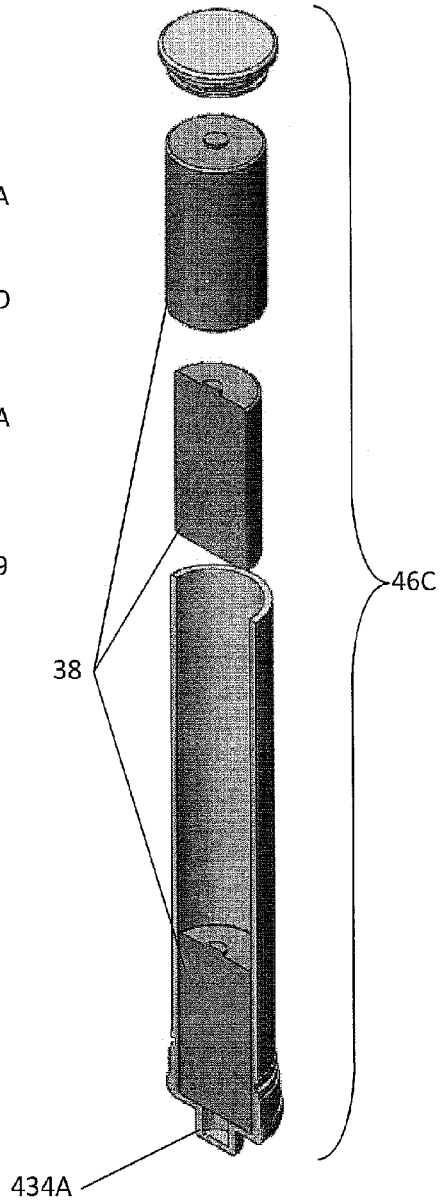
FIG. 22 is an exploded partial cutaway view of the battery cartridge portion of FIG. 20.

Referring to FIG. 14, an inventive showerhead 300 optionally includes a face plate 302 with a plurality of apertures 20 therein. Behind the face plate 302 is an optional needle plate 214 that house one or more needles 216. A needle 216 is optionally locationally associated with an aperture 20. In some embodiments the number of needles 216 is equal to the number of apertures 20. In some embodiments the number of needles 216 is fewer than the number of apertures 20. A needle plate 214 optionally includes one or more water supply holes 218 that allow water to pass from behind the needle plate 214 and toward the face plate 212. The relative position of the needle plate 214 and the face plate 212 are optionally adjustable whereby the coarseness of the spray is adjusted. The position of the needle plate 214 is optionally adjustable by commands entered into a control panel 305. The control panel 305 has the attributes of the control panels and drive mechanisms detailed above with respect to the aforementioned figures for repositioning the pins. In some embodiments both the face plate 212 and the needle plate 214 are rotationally movable.

Referring now to FIGS. 15-19, an inventive shower system is shown generally at 400 where like numerals with respect to other application figures having the meaning ascribed thereto. Those reference numerals modified to include an alphabetical modifier denote an element with a different appearance but a like function with respect to the base numeral. The shower system 400 has a slide bar housing 402 in which a carriage 404 travels. While slide bar housing 402 is depicted in a vertical orientation, it is appreciated that the shower system 400 is operative in a variety of orientations. The slide bar housing 402 is readily formed as a unitary piece or from a series of components. A multi-component slide bar housing 402 includes a body 406. Preferably the body 406 includes at least one boss 408 to facilitate securement to a shower chamber substrate. An optional front cover 410 and screw cover 412 are provided in a complementary arrangement relative to the body 406. It is appreciated that a volume enclosed within slide bar housing 402 is readily rendered water resistant or waterproof through edge sealing. Suitable materials from which a slide bar housing 402 or components thereof are formed illustratively include thermoplastics, thermosets, corrosion-resistant metals, corrosion-resistant metal alloys, and ceramics. Slide bar housing 402 includes a rack gear 412. The rack gear 412 is enmeshed with a gear 414 mechanically coupled to a motor 36 by way of a gear train 416 and a worm gear 39; these components and a power supply collectively represent a drive mechanism that is functionally similar to that previously detailed at 57. As a result, rotation of motor 36 is translated into lateral motion of the carriage 404 along the slide bar housing 402. It is appreciated that a rack gear 412 and a mesh gear 414 are readily replaced with a rotary wheel 422 in place of gear 414. Optionally, rack gear 412 is substituted with a smooth or otherwise non-enmeshing contoured surface 424 that contacts a friction wheel 425, as shown in FIG. 18B. Still further, it is appreciated that rotation of an electrical motor 36 can be used to translate a carriage 404 through resort to a pulley drive as shown generally at 426 in FIG. 18C.

The carriage 404 has a control panel 50F including one or more buttons 52 and optional indicator 54 to allow a user to adjust the position of the carriage 404. The control panel is in electrical communication with a printed circuit board 49 contained within an electronic waterproof housing 430. One or more batteries 38 are provided within battery compartment 432. Preferably, the battery compartment 46B is closed with a waterproof cap 434 to allow for battery replacement. The carriage 404 as shown includes separate waterproof compartment 436 that isolates portions of the gear train 416 and the electric motor 36 from humidity associated with the slide bar 402. Electrical communication is maintained between electronic compartment 430, battery compartment 432, and compartment 436 containing the motor and portion of the gear train. Energizing of the electric motor 36 is under the control of the control panel inputs provided through panel 50E to drive the carriage 404 along slide bar housing 402. The slide bar housing 404 includes a shower handle holster 440, the holster 440 having a cutout 442 adapted to receive a conventional shower handle. As a result, shower system 400 is particularly well suited for retrofitting to a conventional handheld shower handle to provide dynamic position of the spray from the showerhead mounted in cutout 442 without additional manual manipulation after engagement of control panel 50E.

FIGS. 20-23 depict an inventive shower system generally at 500 where like numerals with respect to the other application figures have the meaning ascribed thereto. Those reference numerals modified to include an alphabetical modifier denote an element with a different appearance but a like function with respect to the base numeral. A slide bar housing 40D has a spray nozzle 18B that moves along a lead screw 30A. The slide bar housing 40D has a groove 42. The slide bar housing 40D includes apertures adapted to receive fasteners for securing the system 500 to a surface of a shower chamber. Preferably, one or more drain apertures 58 is provided in slide bar housing 40D to facilitate drainage of water therefrom. The lead screw 30A is in mechanical communication with a gear train 32 that engages the motor through worm gear 39. As best shown with reference to FIG. 2, the spray nozzle 18B has a threaded bore 28 that engages the lead screw 30A such that rotation of lead screw 30 crosses the threaded bore 28 to move linearly along the length of lead screw 30A. A control panel 50F allows a user to select a position for spray nozzle 18B or alternatively a dynamic program for continuous motion of 18B along at least a portion of lead screw 30 without additional manual intervention by the user. The control panel 50F, as with the aforementioned control panels, controls displacement of body nozzle 18B. In a preferred embodiment, the control panel 50F is in electrical communication with a printed circuit board with power for the circuit board coming from a dynamo powered by the movement of water from municipal water supply P or through one or more batteries 38. In the instance when a battery 38 is present, the battery 38 is held within a battery compartment 46C. Preferably, the battery compartment 46C is rendered resealable and waterproof through securement of cap 434A. A diverter 100 is optionally present for selecting water flow between the spray nozzle 18B and a handheld shower handle 192A. A supply hose 502 provides fluid communication between the diverter 100 and the shower handle 192A.

Figure 23:
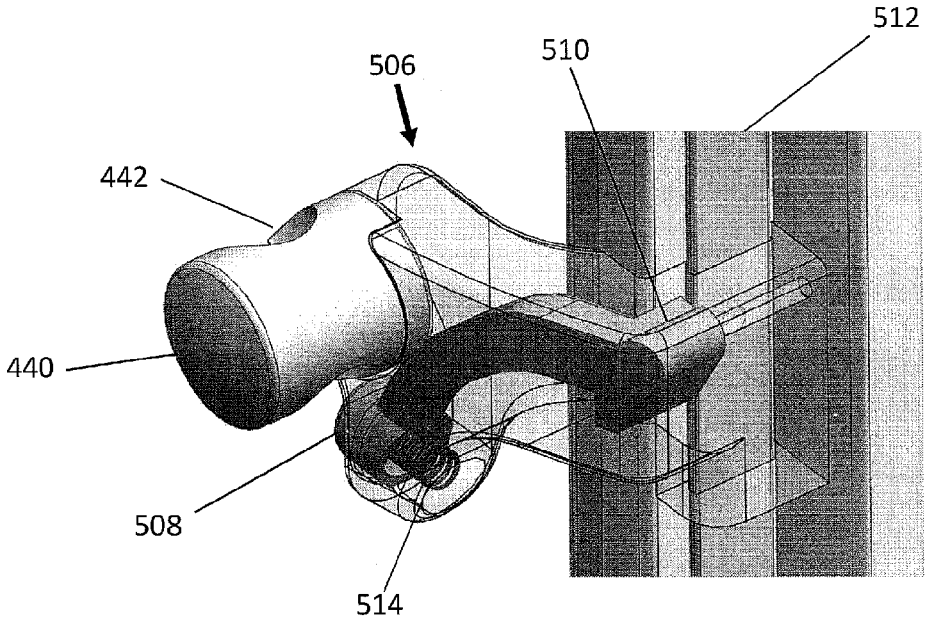
FIG. 23 is a perspective view of the holster portion of the shower system depicted in FIG. 20 with the housing of the slide holster depicted as semitransparent to illustrate the selective spring-loaded slide button and lock.

Optionally, the shower handle 192A engages cutout 442 in a holster 440. Preferably, the holster 440 is displaceable along slide bar housing 40D through the holster 440 being mounted to a slide 506, the slide 506 having a user-depressible button 508 in mechanical communication with a lock 510 that prevents the slide 506 from moving relative to a guide rail 512 that is part of slide bar housing 40D. While the button 508 as depicted in FIG. 23 is biased by a spring 514, it is appreciated that a variety of friction locks are known to the art for allowing selective movement of the slide 506 and thereafter selectively retaining the slide 506 in a desired position.

Figure 24:
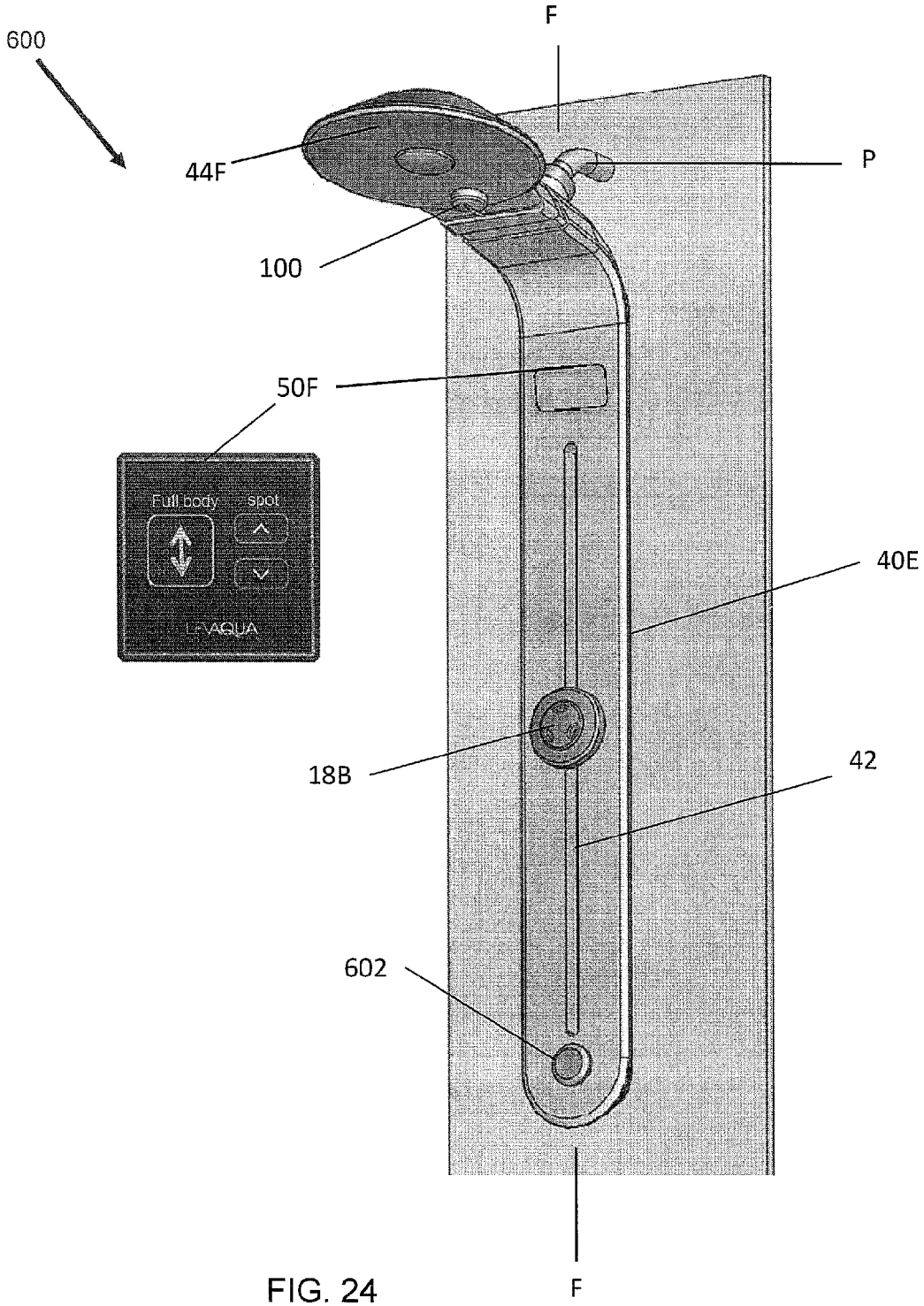
FIG. 24 is a perspective view of an inventive shower system with an inset depicting in greater detail the control panel.
Figure 25:
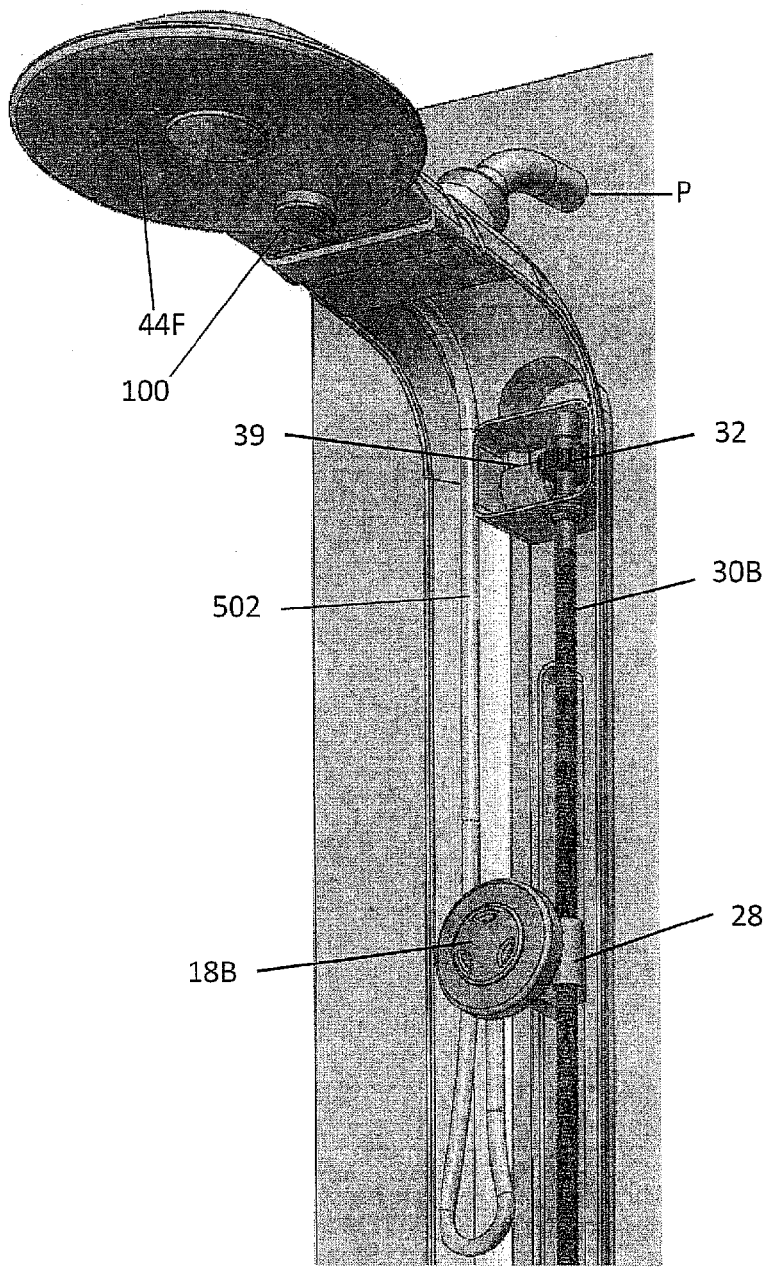
FIG. 25 is a perspective partial cutaway view of the shower system depicted in FIG. 24.
Figure 26:
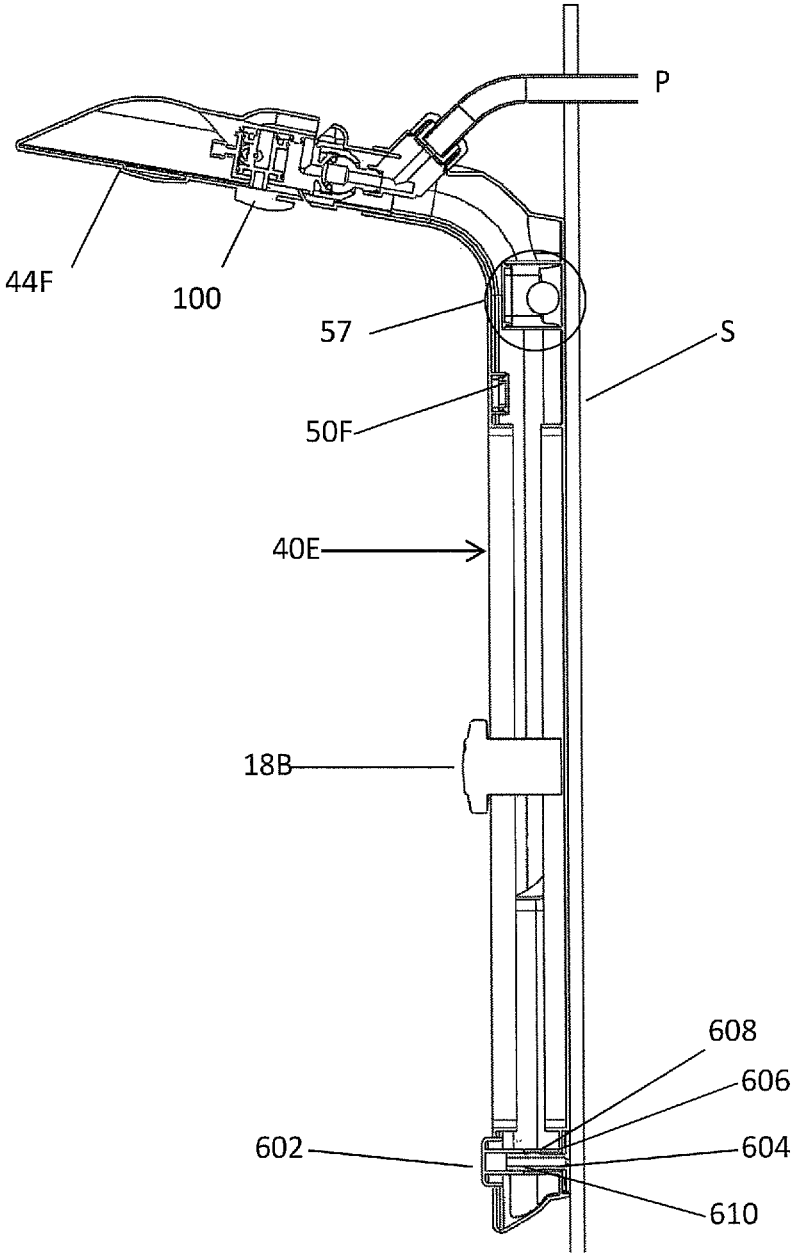
FIG. 26 is a cross-sectional view through the system along line F-F.

Referring now to FIGS. 24-26, where like numerals with respect to the other application figures have the meaning ascribed thereto, an inventive shower system is shown generally at 600. Those reference numerals modified to include an alphabetical modifier denote an element with a different appearance but a like function with respect to the base numeral. The system 600 is operational components that have previously been detailed with respect to the aforementioned figures. The inventive system 600 is appreciated to be particularly well suited for usage with a municipal water supply P entering a shower chamber at a height above that of a typical user with a wall attachment feature of a tightening knob 602 for engagement against an adhesive pad 604 securing a stem 606 having threads 608 that are complementary to and engage with those found on tightening knob 602. Optionally, the stem 606 has a central bore 610 to provide the option of a mechanical fastener to secure slide bar housing 40E to a substrate S of the shower chamber.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A powered hygiene shower spray system comprising:

a slide bar housing adapted for mounting to a substrate;

a moving head or spray nozzle having a plurality of nozzle apertures, said moving head or said spray nozzle movable along said slide bar housing on a carriage;

a hose in fluid communication between said spray nozzle and a water supply;

a control panel, having two or more buttons for providing a user input as to a parameter of at least one of said moving head or said spray nozzle, and said control panel being integral with said carriage or said slide bar housing; and a drive mechanism for completing said parameter of the moving of said moving head or said spray nozzle without user manual manipulation subsequent to the user input.

2. The system of claim 1 wherein said carriage has a gear train in mechanical communication with said slide bar housing, said spray nozzle moving in concert with said carriage.

3. The system of claim 2 wherein the mechanical communication is between a gear coupled to said gear train and a rack gear on a surface of said slide bar housing.

4. The system of claim 2 wherein said control panel and said drive mechanism are within said carriage.

5. The system of claim 1 said drive mechanism further comprises a battery power supply.

6. The system of claim 1 wherein the parameter is an extent of linear motion or dynamic linear motion.

7. The system of claim 1 wherein said spray nozzle is in a body with a shower handle said shower handle selectively resting in a cutout in a holster, said holster secured to said carriage.

* * * * *